US007828180B2

(12) United States Patent
Slesar

(10) Patent No.: US 7,828,180 B2
(45) Date of Patent: Nov. 9, 2010

(54) QUICK-RELEASE SUPPORT STRAP DEVICE

(76) Inventor: Jeff Slesar, 1505 Deep Creek Rd., Fortine, MT (US) 59918

( * ) Notice: Subject to any disclaimer, the term of this patent is extended or adjusted under 35 U.S.C. 154(b) by 1522 days.

(21) Appl. No.: 11/044,664

(22) Filed: Jan. 27, 2005

(65) Prior Publication Data

US 2006/0163304 A1 Jul. 27, 2006

(51) Int. Cl.

| | |
|---|---|
| ***A45F 3/02*** | (2006.01) |
| ***A45F 3/14*** | (2006.01) |
| ***A01K 1/08*** | (2006.01) |
| ***A45C 13/30*** | (2006.01) |
| ***A45C 1/04*** | (2006.01) |

(52) U.S. Cl. ..... 224/257; 224/601; 224/617; 224/667; 224/254; 119/776

(58) Field of Classification Search ..... 224/257, 224/254, 913, 150, 617, 601, 667; 119/776
See application file for complete search history.

(56) References Cited

U.S. PATENT DOCUMENTS

| | | | | | |
|---|---|---|---|---|---|
| 1,979,375 | A | * | 11/1934 | Fielding | 24/521 |
| 3,153,791 | A | * | 10/1964 | White | 2/460 |
| 4,562,945 | A | * | 1/1986 | Erlandson | 224/150 |
| 5,103,771 | A | * | 4/1992 | Lee | 119/776 |
| 5,165,584 | A | * | 11/1992 | Meagher et al. | 224/258 |
| RE34,351 | E | * | 8/1993 | Lacey | 119/776 |
| D350,628 | S | * | 9/1994 | Williams | D30/153 |
| 5,358,159 | A | * | 10/1994 | Lundie, Jr. | 224/624 |
| 5,441,017 | A | * | 8/1995 | Lindsay | 119/795 |
| 5,624,065 | A | * | 4/1997 | Steffe | 224/625 |
| 5,718,192 | A | * | 2/1998 | Sebastian | 119/795 |
| 5,727,500 | A | * | 3/1998 | Conboy | 119/174 |
| 5,749,326 | A | * | 5/1998 | Jones et al. | 119/798 |
| 5,873,328 | A | * | 2/1999 | Campbell | 119/798 |
| 5,915,336 | A | * | 6/1999 | Watson | 119/797 |
| 6,073,590 | A | * | 6/2000 | Polding | 119/795 |
| 6,085,695 | A | * | 7/2000 | Miller et al. | 119/795 |
| 6,323,409 | B1 | * | 11/2001 | Surber | 84/453 |
| 6,382,139 | B1 | * | 5/2002 | Rhodes | 119/776 |
| 6,418,881 | B1 | * | 7/2002 | Starratt | 119/795 |

* cited by examiner

*Primary Examiner*—Nathan J Newhouse
*Assistant Examiner*—Lester L Vanterpool
(74) *Attorney, Agent, or Firm*—Stinson Morrison Hecker LLP

(57) ABSTRACT

A quick-release support strap device includes a longitudinally extended support strap having a first generally elastic section and a second mounting clip connection section. A releasable strap securement device such as a clip is mounted on the first generally elastic section for releasably connecting the support strap to a securement object, and a mounting clip is mounted on the second mounting clip connection section including a clip body, a clip arm pivotably mounted on the clip body and a releasable latch mounted on the clip body operative to releasably retain at least a portion of the clip arm therein. A cord is housed at least partially within the support strap and is operatively connected to the releasable latch on the mounting clip, the cord operative to disengage the releasable latch to release the portion of the clip arm therefrom to release the clip arm and open the mounting clip.

14 Claims, 5 Drawing Sheets

QUICK-RELEASE SUPPORT STRAP DEVICE

BACKGROUND OF THE INVENTION

1. Technical Field

The present invention relates to support straps for objects and, more particularly, to a quick-release support strap device which includes a longitudinally extended support strap having a first generally elastic section and a second mounting clip connection section, a mounting clip mounted on the mounting clip connection section which includes a latch, a releasable strap securement device for connecting the support strap to a securement object and a generally flexible tensioning member such as a cord which is connected to and extends from the latch on the mounting clip through the body of the support strap to a position intermediate the opposite ends of the support strap such that the mounting clip may be connected to a device for support thereof with the strap extending over and around the neck of the individual wearing the device for connection to the pants or belt of the person such that the object being supported may be quickly released from the strap by pulling the cord to disengage the latch.

2. Description of the Prior Art

Hunting is a very popular pastime which is undertaken by millions of individuals throughout the United States. There are many different types of methods of hunting which are currently practiced, but one of the more common hunting methods is to walk through an area having game therein until the game is encountered, at which time the hunter would attempt to shoot the game animal to kill it. Of course, because the vast majority of animals which are hunted are wild animals, they are naturally wary of intruders who enter their habitat area. It is therefore quite common for a hunter to walk for several hours through the area in which he or she is hunting and only take a couple of shots at game animals during that entire time. The remainder of the time, the hunter must support the rifle or shotgun he or she is carrying in a ready position in order to ensure a quick response to the flushing of any game animal. Needless to say, this can grow quite tiring for the hunter, particularly in the shoulder, arms, and back areas of the hunter which provide the majority of support for the weight of the rifle or shotgun. There is therefore a need for a supplemental support device which can be used to support at least some of the weight of the rifle or shotgun, yet which will not significantly impede use of the rifle or shotgun in a shooting situation.

Several devices have been proposed in the prior art for releasably supporting a rifle or shotgun during hunting, including Unger, U.S. Pat. No. 475,640, and Pendergrass, U.S. Pat. No. 2,526,768. The natures of these devices, however, render it quite difficult to quickly and easily remove the rifle or shotgun from the gun rest and use it as is necessary when the game animal is flushed from its place of hiding and the hunter must quickly respond to the event. There is therefore a need for an improved gun support device which will quickly release the gun from the support position allowing use of the gun in a quick and responsive manner, yet will also provide support for the gun when not in use in a manner which is comfortable for the user of the device.

Therefore, an object of the present invention is to provide a quick-release support strap device which can be used for the support of a rifle or shotgun.

Another object of the present invention is to provide a quick-release support strap device which extends over and around the user's neck and connects to the front part of the wearer's clothing, the support strap also frictionally engaging the user's clothing adjacent the neck and shoulder area to provide support for the rifle or shotgun being supported thereby.

Another object of the present invention is to provide a quick-release support strap device which includes a longitudinally extended support strap having an elastic section and a mounting clip connection section, with a releasable strap securement device mounted on the elastic section for securement to the pants or belt of an individual and a mounting clip mounted on the mounting clip connection section which includes a quick-release latch for quickly releasing the mounting clip to release the gun being engaged thereby.

Another object of the present invention is to provide a quick-release support strap device which further includes a generally flexible tensioning member such as a cord which extends from the latch on the mounting clip through the body of the support strap to the opposite side of the wearer's neck such that the wearer may quickly grasp the cord and pull it with his or her free hand to free the gun while grasping the rifle with the other hand to move the rifle to the ready position in a quick and expedient manner.

Another object of the present invention is to provide an improved quick-release support strap device which can be used for support of other objects such as backpacks, carrying bags and other such objects, in addition to its primary use for support of a rifle or shotgun.

Another object of the present invention is to provide a quick-release support strap device which may be quickly and easily connected to the individual's clothing and then to the rifle or shotgun being carried by the individual to facilitate the use of the support strap device of the present invention; and Finally, an object of the present invention is to provide an improved quick-release support strap device which is relatively simple and durable in construction and is safe, efficient, and expedient in use.

SUMMARY OF THE INVENTION

The present invention provides a quick-release support strap device which includes a longitudinally extended support strap having a first generally elastic section having a strap connection end and a second mounting clip connection section having a mounting clip connection end opposite the connection end. A releasable strap securement device such as a clip or other such device is mounted on the first generally elastic section adjacent the strap connection end for releasably connecting the support strap to a securement object, and a mounting clip is mounted on the second mounting clip connection section generally adjacent the mounting clip connection end, the mounting clip including a clip body, a clip arm pivotably mounted on the clip body and a releasable latch mounted on the clip body operative to releasably retain at least a portion of the clip arm therein to alternately secure and release the clip arm to open and close the mounting clip. A generally flexible tensioning member such as a cord includes a first end operatively connected to the releasable latch on the mounting clip and an outer end, the generally flexible tensioning member operative to disengage the releasable latch to release the portion of the clip arm therefrom to release the clip arm and open the mounting clip. The generally flexible tensioning member is at least partially slidably housed within the second mounting clip connection section of the support strap such that the outer end of the generally flexible tensioning member is engagable to tension the generally flexible tensioning member to slide within the support strap and disengage the latch. Finally, the mounting clip is operative to releasably engage an object suspended on a wearer's shoulder and the longitudinally extended support strap is operative to extend around the neck portion of a wearer of the longitudinally extended support strap and be releasably secured via the releasable strap securement means on the wearer below the neck portion thereof such that the object is generally prevented from dislodging from the wearer's shoulder.

The present invention as thus described provides many advantages over those devices or methods found in the prior art. For example, because the latch of the quick-release support strap device of the present invention is disengaged by the free hand of the user, the gun supporting hand is free to quickly move the gun into a firing position while the free hand of the gun user can then move to support the gun in the firing position. Also, because the weight of the gun is supported by the support strap during non-use of the gun, the user of the present invention will not use valuable energy supporting the gun while he or she is walking around the hunting area, thus leaving greater energy reserved available when needed by the hunter. Furthermore, because the cord of the present invention extends within the support strap, fraying and tangling of the cord is generally prevented which provides added insurance for the proper functioning of the quick-release support strap device of the present invention when release of the gun is needed. Finally, and perhaps most importantly, the quick-release support strap device of the present invention is usable not only with rifles and shotguns, but with many different types of bags, backpacks, knapsacks, or other such carrying devices, as the clip will engage the shoulder strap of the carrying device and support the weight of the device around the neck and back of the wearer instead of directly on the shoulder of the wearer. It has been found that this redistribution of the weight of the bag is beneficial and such additional use of the quick-release support strap device of the present invention is not found in the prior art. It is therefore seen that the present invention provides a substantial improvement over those devices and methods found in the prior art.

DESCRIPTION OF THE PREFERRED EMBODIMENT

Figure 1:
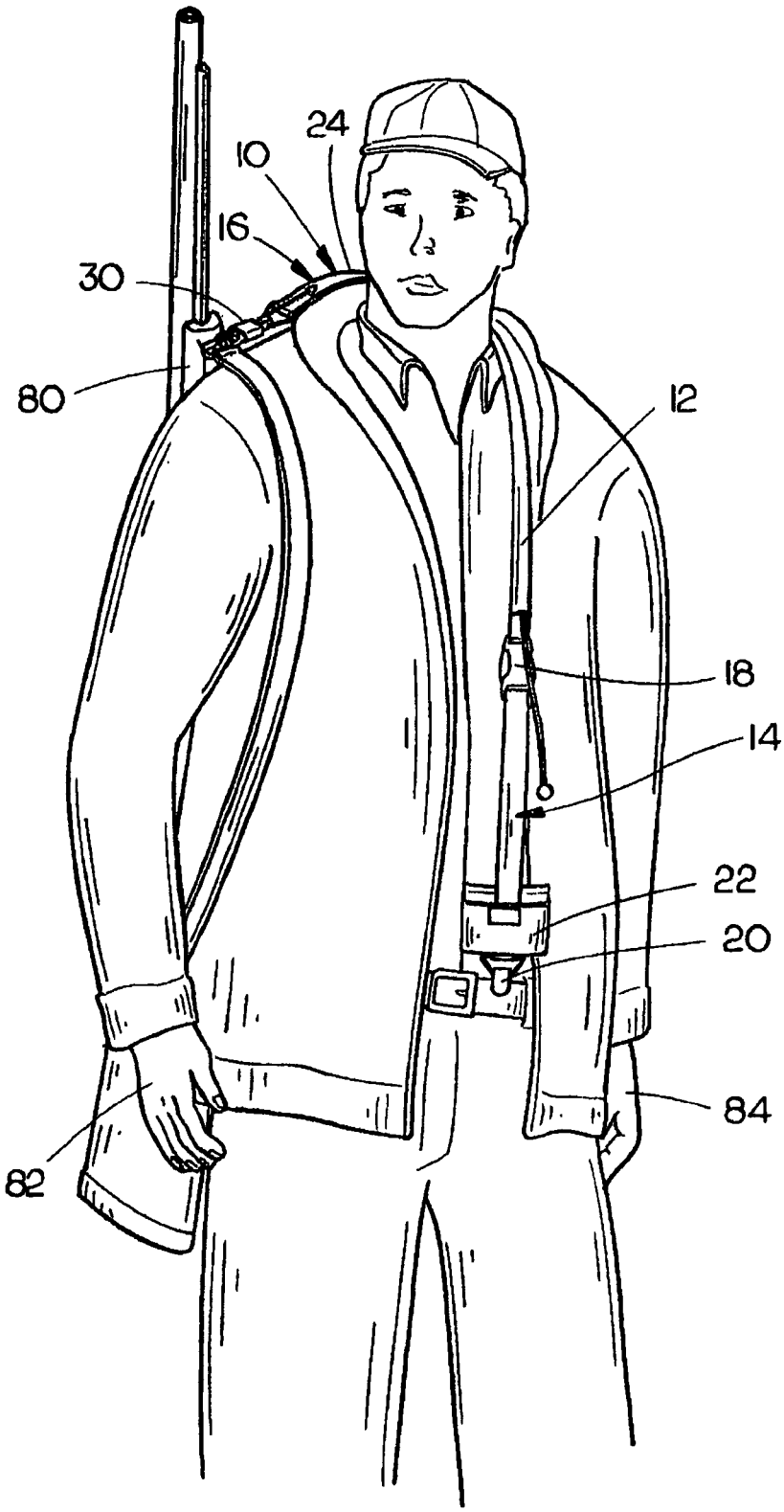
FIG. 1 is a perspective view of the quick-release support strap device of the present invention being used to support a gun.
Figure 2:
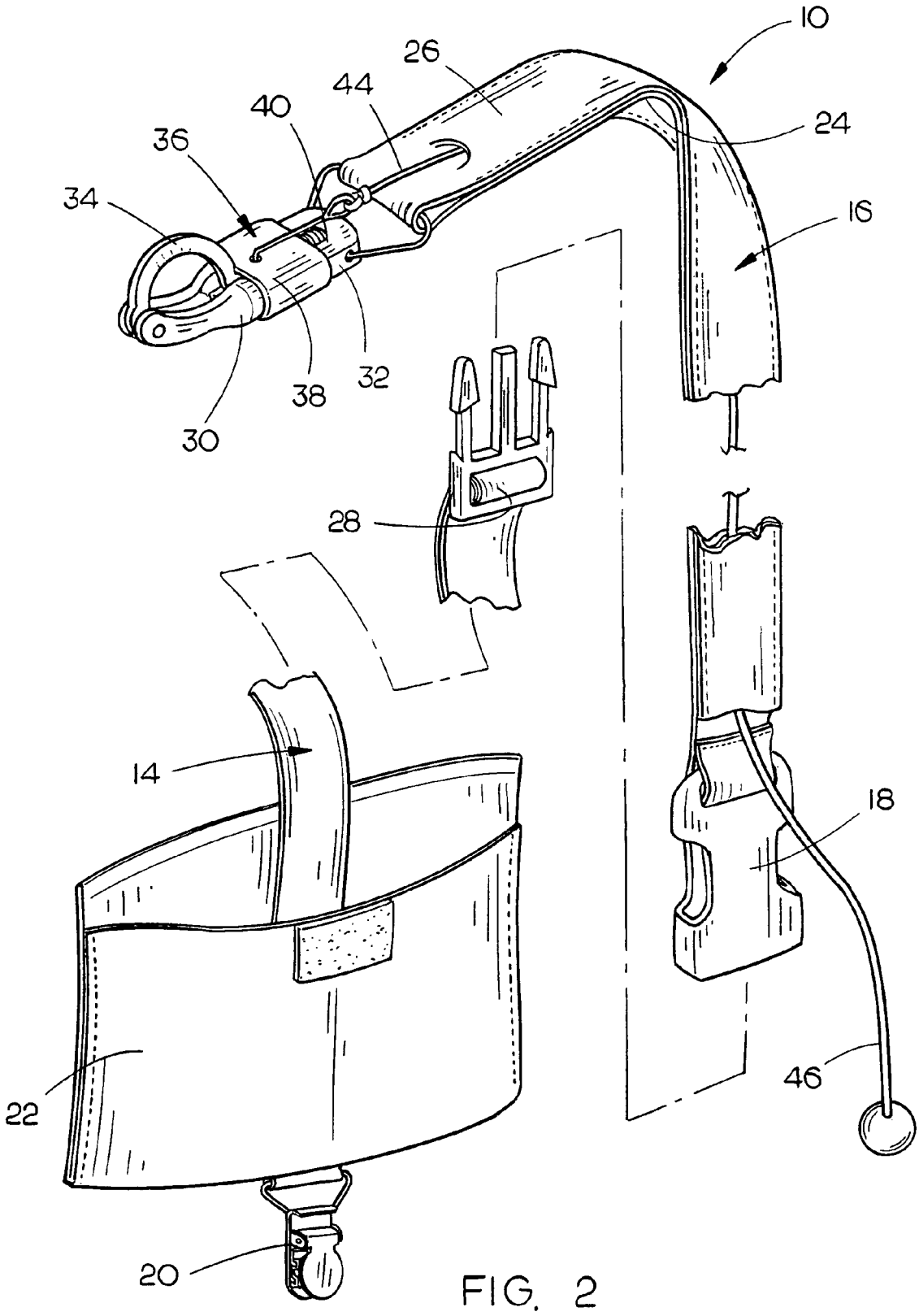
FIG. 2 is a detailed perspective view of the quick-release support strap device.
Figure 3:
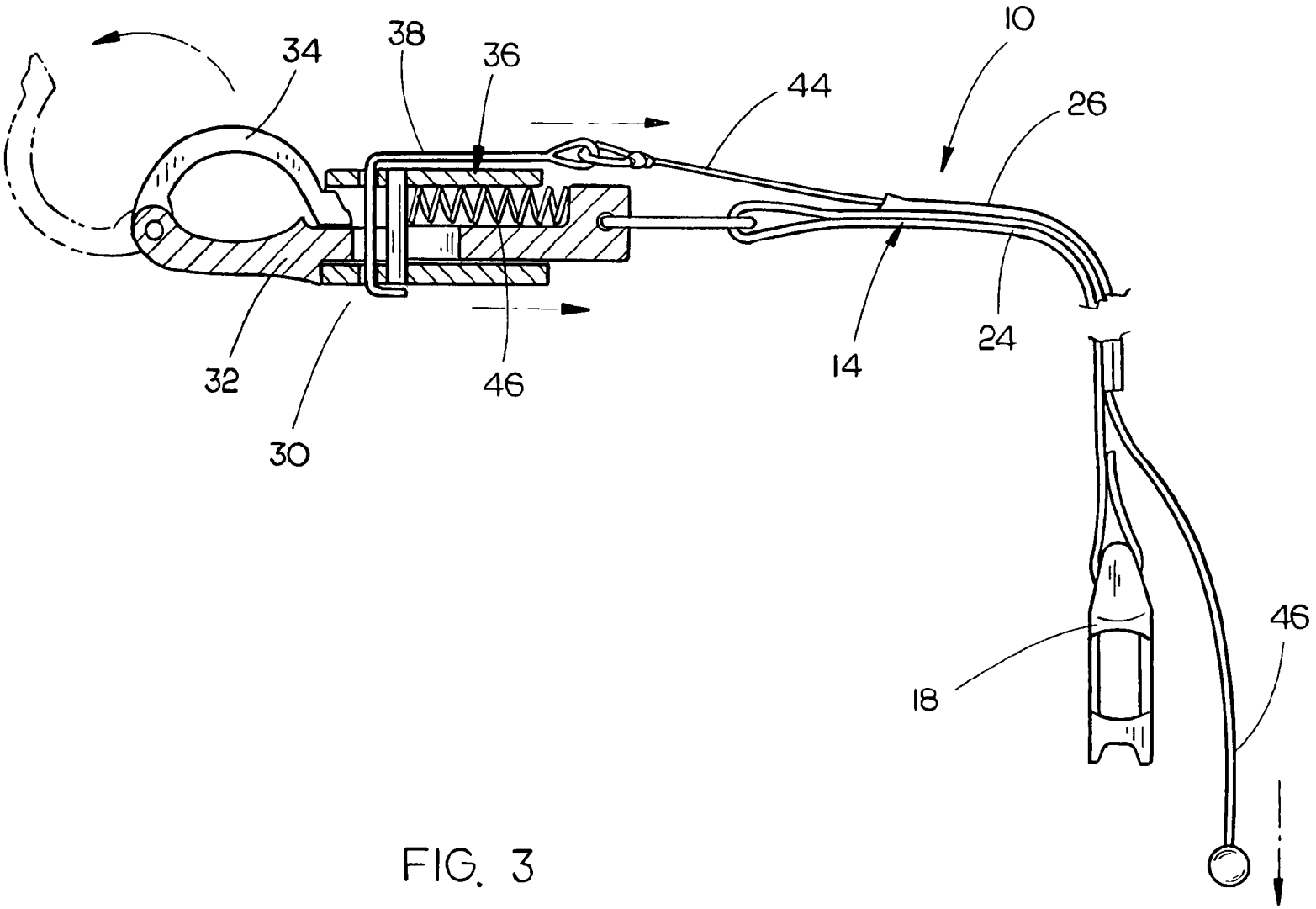
FIG. 3 is a detailed side elevational view of the mounting clip mechanism of the present invention.

The quick-release support strap device 10 of the present invention is shown best in FIGS. 1-3 as including a longitudinally extended support strap 12 having a first generally elastic section 14 and a second mounting clip connection section 16. The first elastic section 14 and second mounting clip connection section 16 would preferably be connected to one another by an intermediate strap clip 18, as shown best in FIGS. 1 and 2, although it may be preferable to construct the support strap 12 as a unitary piece should such a design change prove beneficial. However, it has been found that constructing the support strap 12 as shown in FIGS. 1 and 2 renders the quick-release support strap device 10 of the present invention easier to use and also easier to assemble.

In the preferred embodiment, first elastic section 14 of support strap 12 would have a length of approximately six to eighteen inches when untensioned and would be constructed of any of a number of different types of elastic strap material which are commonly used in connection with elastic straps found in the prior art. Mounted to the end of first elastic section 14 opposite intermediate strap clip 18 is a releasable strap securement device 20 which, in the preferred embodiment, would be a clip such as the kind used to connect suspenders to a belt or directly to the individual's pants. The important features of the releasable strap securement device 20 would include that it may be attached to a belt or other article of clothing without causing damage to the article of clothing and that it will be quickly and easily releasable therefrom when removal of the quick-release support strap device 10 of the present invention from the individual is desired. Therefore, the precise structural features of the releasable strap securement device 20 are not critical to the present invention, whereas the functional features of the releasable strap securement device 20 are important, and therefore the functional features will dictate the specific nature of the releasable strap securement device 20 of the present invention.

Finally, mounted intermediate the releasable strap securement device 20 and the intermediate strap clip 18 on first elastic section 14 is a strap containment bag 22 which is designed to receive and retain the quick-release support strap device 10, particularly support strap 12, within the strap containment bag 22 when the present invention is not being used. Of course, the inclusion of strap containment bag 22 is not critical to the present invention, but it has been found that the inclusion of the strap containment bag 22 facilitates use of the quick-release support strap device 10 of the present invention and therefore its inclusion is desirable. The exact size, shape, and other features of the strap containment bag 22 are not critical to the present invention so long as the support strap 12 is releasably retained within the strap containment bag 22 when not in use.

The second mounting clip connection section 16 of support strap 12 is shown best in FIGS. 1-3 as including a generally flexible fabric strap 24 connected at one end thereof to the intermediate strap clip 18 and at the other end thereof to a mounting clip 30. In the preferred embodiment, the fabric strap 24 would preferably have a length of approximately twenty-four to thirty-six inches and the width of approximately one-half to one inch, depending on the size of the individual wearing the quick-release support strap device 10 of the present invention and the weight the support strap 12 is intended to carry. Also, it should be noted that although the fabric strap 24 has been described as being constructed of a woven-type fabric material, it may be constructed of any appropriate construction material, including flexible steel, plastic, rubber, or any other such construction material.

The mounting clip 30 is shown best in FIGS. 2 and 3 as including a mounting clip body 32 and a mounting clip arm 34 pivotally mounted on the mounting clip body 32, such that the mounting clip arm 34 may pivot between an engaged position where the outer end of mounting clip arm 34 is in contact with the mounting clip body 32 and a disengaged position where the mounting clip arm 34 is pivoted away from the mounting clip body 32 thus opening mounting clip 30. The exact size, shape, and structure of the mounting clip 30, however, is not critical to the present invention so long as the function of retaining the mounting clip arm 34 in the engaged and disengaged positions is maintained. Actually, the critical functional design issue found in connection with the mounting clip arm 34 is that the mounting clip arm 34 must be able to engage the rifle 80, specifically a fastening location thereon, for easy engagement and rapid disengagement of the mounting clip arm 34 from the rifle 80. It is this functional consideration which will generally dictate the shape and size of the mounting clip arm 34 and hence mounting clip body 32 and mounting clip 30.

To secure the mounting clip arm 34 in engaged position adjacent mounting clip body 32, a latch device 36 is slidably mounted on the mounting clip body 32, the latch device 36 including a latch plate 38 having a generally C-shaped cross-sectional shape which fits over and around mounting clip body 32 and slides forwards and rearwards thereon, as shown best in FIG. 3. In the preferred embodiment, the latch device 36 would further include a spring biasing device 40 which biases the latch plate 38 forwards on mounting clip body 32 to retain the mounting clip arm 34 in engaged position with mounting clip body 32, thus closing mounting clip 30.

To move latch plate 38 rearwards on mounting clip body 32, a latch release cord 44 is connected to the latch plate 38 at the rear end thereof, the latch release cord 44 extending along second mounting clip connection section 16 of support strap 12 towards intermediate strap clip 18, as shown best in FIGS. 1-3. In the preferred embodiment, the latch release cord 44 would be housed within a protective cord sleeve 26 mounted on fabric strap 24 of second mounting clip connection section 16, as shown best in FIGS. 2 and 3. The cord sleeve 26 both protects the latch release cord 44 and generally prevents tangling of the latch release cord 44, but its most important function is to bring the outer end 46 of latch release cord 44 around the wearer's neck to the opposite side of the wearer adjacent his or her free hand such that the latch release cord 44 can be operated by the free hand of the individual wearing the quick-release support strap device 10 of the present invention. It should be noted that the cord sleeve 26 may not be needed if the latch release cord 44 is housed within the fabric strap 24 itself, but in either event, the important consideration is that the latch release cord 44 extend around the wearer's neck for use by the free hand of the individual.

When tension is applied to the latch release cord 44, the latch plate 38 of latch device 36 is moved rearwards on mounting clip body 32 which permits the mounting clip arm 34 to disengage from mounting clip body 32 and thus be released. When the latch release cord 44 is released, the spring biasing device 40 forces latch plate 38 forwards on mounting clip body 32, and if the mounting clip arm 34 has been swung into engage position on mounting clip body 32, the mounting clip arm 34 is secured in engaged position with mounting clip body 32 and the quick-release support strap 10 is once again ready for use.

The use of the present invention is best shown in FIGS. 1 and 3 wherein the individual using the device would first connect the releasable strap securement device 20 to his or her belt or top of their pants and then would remove the support strap 12 from the strap containment bag 22. Intermediate strap clip 18 would then be disengaged to separate the support strap 12 into first elastic section 14 and second mounting clip connection section 16, and the second mounting clip connection section 16 would be connected to the rifle 80 to be supported by engaging the mounting clip 30 to connect the mounting clip arm 34 to the rifle 80, as shown best in FIG. 1, preferably at the location where the rifle strap connects to the rifle body. The second mounting clip connection section 16 would then be brought behind the wearer's neck to extend around and down from the wearer's neck where the second mounting clip connection section 16 would be connected to the first elastic section 14 by the intermediate strap clip 18. The length of the support strap 12 would then be adjusted by any appropriate length adjustment device 28 until the length of the support strap 12 is correct and the quick-release support strap device 10 fits comfortably on the individual wearing the device. The rifle 80, and particularly the rifle strap, is thus prevented from sliding off of the wearer's shoulder by the support strap 12 until the individual wearing the device decides to use the rifle.

When the individual decides to use the rifle 80, he or she would quickly grasp the rifle 80 with their shooting hand 82 and then reach to grasp the outer end 46 of latch release cord 44 with his or her opposite free hand 84. When the latch release cord 44 is pulled downwards, it slides within cord sleeve 26 on fabric strap 24 to pull latch plate 38 rearwards on mounting clip body 32 to release the mounting clip arm 34 which had been previously engaging the rifle 80 and preventing the shoulder strap of the rifle from sliding off of the wearer's shoulder. When the mounting clip arm 34 is released from mounting clip body 32, it pivots outwards and downwards as shown in FIG. 3, and the rifle 80 is immediately released from connection to the mounting clip 30 to enable it to be brought to the firing position in preparation for firing. The user of the quick-release support strap device 10 of the present invention may then shift his or her free hand 84 from the latch release cord 44 to the rifle 80 for aiming purposes and the rifle 80 may then be used as it ordinarily would be used.

Figure 4:
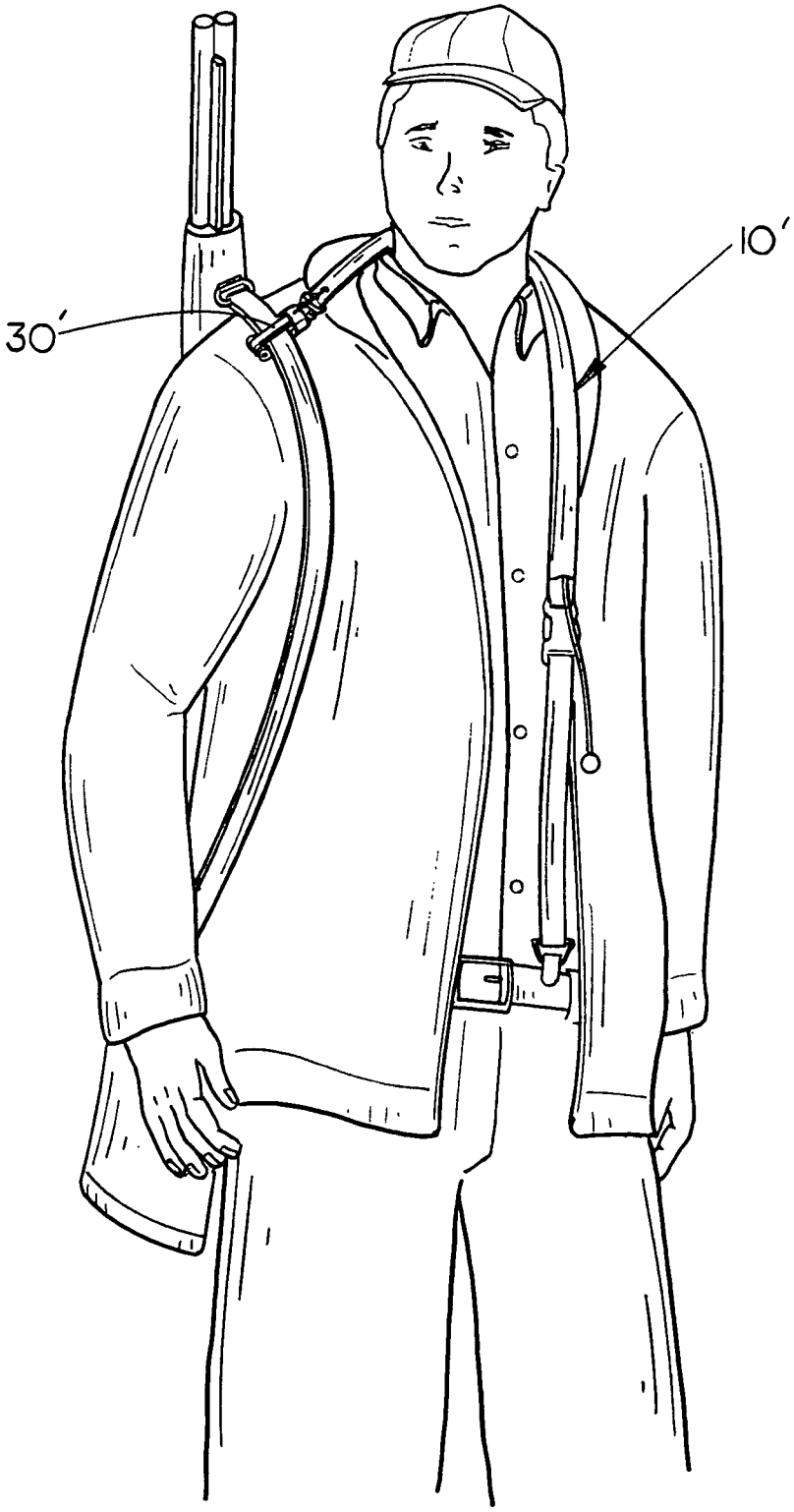
FIG. 4 is a perspective view of an alternative embodiment of the present invention being used to support a gun.
Figure 5:
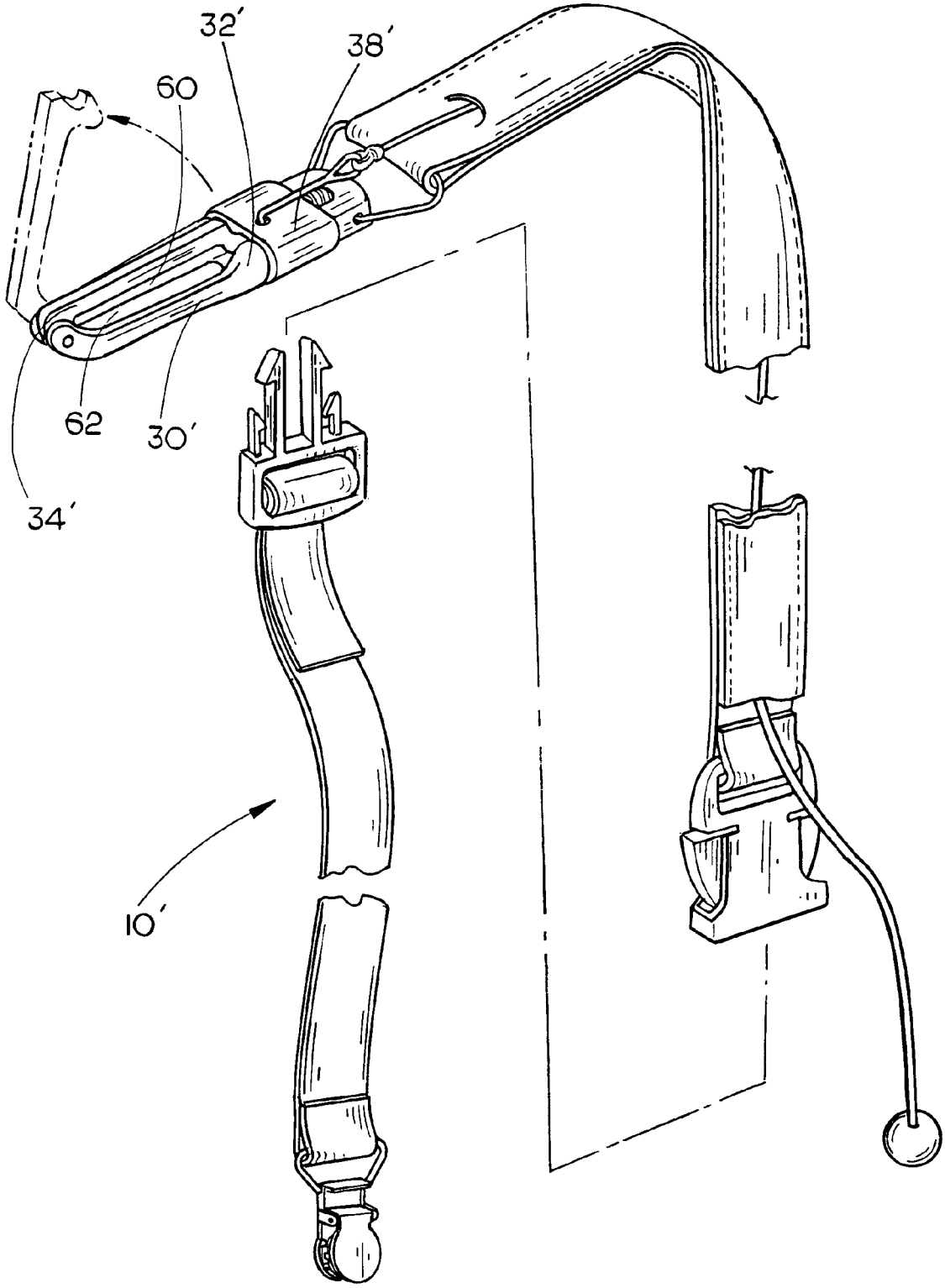
FIG. 5 is a detailed perspective view of the second embodiment of the present invention showing a variation in the type of mounting clip used in connection with the invention.

An alternative embodiment of the quick-release support strap device 10' of the present invention is shown in FIGS. 4 and 5 as including only one significant modification, specifically to the shape and design of mounting clip 30'. As shown best in FIG. 5, the shape of mounting clip arm 34' and mounting clip body 32' would be modified such that the mounting clip arm 34' and mounting clip body 32' engage one another along at least a portion of the length thereof intermediate the pivot connection between the two and the positioning of the latch plate 38'. This engagement between the mounting clip arm 34' and mounting clip body 32' permits straps for various bags, rifles, or other such objects not having a ready connection point for the mounting clip 30 of the embodiment of FIG. 1 to be frictionally engaged by the mounting clip 30, as shown in FIG. 4, and thus permits the second embodiment of the present invention to be used in connection with many other different types of objects. As was stated previously, the precise size and shape of the mounting clip body 32' and mounting clip arm 34' may be modified or changed for use with many different types of objects, as shown in FIGS. 4 and 5, and such modification should be understood to be a part of this disclosure. The remaining functional features of the quick-release support strap device 10' as shown in FIGS. 4 and 5 remain generally identical to the features disclosed in connection with the embodiment of FIGS. 1-3, and the operation of the quick-release support strap device 10' would be substantially identical to the operation of the embodiment of FIGS. 1-3. One additional feature of the quick-release support strap device 10' of the present invention may be to include rubberized clip inserts 60 and 62 which would increase the frictional contact of the mounting clip arm 34 and mounting clip body 32 to the strap 90 to which the mounting clip 30 is to be connected, although the inclusion of such rubberized frictional inserts 60 and 62 is not critical to the present invention.

It is to be understood that numerous additions, modifications, and substitutions may be made to the quick-release support strap device 10 of the present invention which fall within the intended broad scope of the appended claims. For example, the size, shape, and construction materials used in connection with the quick-release support strap device 10 may be modified or changed so long as the important functional features of the device are maintained. Also, although the present invention has been described as being used primarily in connection with the support and securement of a rifle or shotgun on the wearer's shoulder, it is intended to be used in virtually any situation where the securement of an object on a wearer's shoulder is to be supplemented. Finally, it should be noted that the specific size and shape of the mounting clip 30 may be modified or changed for use with many different types of objects, although it has been found that the two embodiments described above are usable in connection with the majority of objects which will be secured by the present invention.

There has therefore been shown and described a quick-release support strap device 10 which accomplishes at least all of its intended objectives.

I claim:

1. A quick-release support strap device configured to support an object suspended on a first shoulder of a wearer, comprising:

a longitudinally extended support strap comprising first and second sections, said first section being generally elastic and comprising first and second ends, and said second section being generally non-elastic and comprising a first end coupled with said first end of said first section and a second end, wherein said first section has a length to extend from its second end generally adjacent the wearer's waist to its first end below the wearer's neck, and said second section has a length to extend from its second end adjacent the wearer's first shoulder, behind the wearer's neck and over a second shoulder of the wearer to its first end above the wearer's waist;

a releasable strap securement device mounted on said second end of said first generally elastic section for releasably connecting said support strap to the wearer generally adjacent the wearer's waist;

a mounting clip mounted on said second end of said second section , said mounting clip including a clip body, a clip arm movably mounted on said clip body and a releasable latch mounted on said clip body operative to releasably retain at least a portion of said clip arm therein to alternately secure and release said clip arm to open and close said mounting clip, wherein said mounting clip is operative to releasably engage the object suspended on the wearer's first shoulder for preventing the object from dislodging from the wearer's shoulder;

a generally flexible tensioning member having a first end operatively connected to said latch on said mounting clip and an outer end, said generally flexible tensioning member operative to open said mounting clip, said tensioning member having a length to extend from its first end behind the wearer's neck and over the wearer's second shoulder so that said outer end is positioned at or above the wearer's waist; and a protective sleeve mounted to said second section of said support strap for slidably housing said tensioning member between said second section and said protective sleeve; and, an intermediate strap clip interposed between and releasably connecting said first generally elastic section and said second section.

2. The quick-release support strap device of claim 1 wherein said releasable latch comprises a latch plate having a generally C-shaped cross-sectional shape adapted to fit over and around said clip body, said latch plate operative to alternatively slide forward and rearward on said clip body to alternatively retain and release said clip arm in engaged position with said clip body.

3. The quick-release support strap device of claim 2 wherein said releasable latch further comprises a spring biasing device operative to bias said latch plate forwards on said clip body to retain said clip arm in engaged position with said clip body, thereby closing said mounting clip.

4. The quick-release support strap device of claim 3 wherein said generally flexible tensioning member comprises a latch release cord, said latch release cord connected to said latch plate such that upon tension being applied to said latch release cord, said latch plate of said releasable latch is moved rearwards on said clip body thus permitting said clip arm to disengage from said clip body to open said mounting clip and upon tension on said latch release cord being released, said spring biasing device forces said latch plate forwards on said clip body to secure said clip arm in engaged position with said clip body thereby closing said mounting clip.

5. The quick-release support strap device of claim 1 wherein said protective sleeve is mounted on said second section, said protective sleeve operative to protect said generally flexible tensioning member, to generally prevent tangling of said generally flexible tensioning member and to guide said outer end of said generally flexible tensioning member around the wearer's neck to the opposite side of the wearer adjacent his or her free hand such that said generally flexible tensioning member is operable by the free hand of the individual wearing said quick-release support strap device.

6. The quick-release support strap device of claim 1 wherein said clip arm is pivotably mounted on said clip body of said mounting clip and said clip arm and said clip body engage one another along at least a portion of the length thereof intermediate the pivot connection between said clip arm and said clip body and said releasable latch whereby a strap connected to an object supported on the shoulder of the wearer of said quick-release support strap device is frictionally engaged by said mounting clip to retain the strap within said mounting clip.

7. The quick-release support strap device of claim 6 further comprising a pair of rubberized clip inserts, one mounted on each of said clip arm and said clip body such that said rubberized clip inserts engage one another along at least a portion of the length thereof intermediate the pivot connection between said clip arm and said clip body and said releasable latch, said pair of rubberized clip inserts operative to increase the frictional contact of said clip arm and said clip body to a strap to which said mounting clip is to be connected.

8. A method of supporting an object suspended on a first shoulder of a wearer, comprising:

providing a support strap device comprising:

a support strap comprising a first end and a second end;

a releasable strap securement device coupled with said support strap adjacent said first end;

a mounting clip coupled with said support strap adjacent said second end, said mounting clip operable to move between an engaged position and a disengaged position;

a release cord comprising a first end coupled with said mounting clip and an outer end, wherein said release cord is operable to move said mounting clip between said engaged position and said disengaged position; and a protective sleeve mounted on said support strap, wherein at least a portion of said release cord is positioned between said protective sleeve and said support strap;

securing said releasable strap securement device to the wearer below the wearer's neck;

positioning said support strap so that it extends from said releasable strap securement device below the wearer's neck over a second shoulder of the wearer and behind the wearer's neck such that said mounting clip is positioned adjacent to the wearer's first shoulder and said outer end of said release cord is positioned below the wearer's second shoulder; and engaging said mounting clip with the object suspended on the first shoulder of the wearer for preventing the object from sliding off the first shoulder of the wearer.

9. The method of claim 8, further comprising tensioning said release cord to move said mounting clip from its engaged position to its disengaged position, whereby said mounting clip disengages the object suspended on the first shoulder of the wearer.

10. The method of claim 8, wherein said support strap device further comprises a first section comprising said first end, a second section comprising said second end, and an intermediate strap clip operable to connect said first section and said second section, said method further comprising the steps of:

connecting said first section and said second section with said intermediate strap clip after the steps of securing said releasable strap securement device and engaging said mounting clip with the object.

11. The method of claim 8, wherein said object comprises a shoulder strap and said support strap device prevents said shoulder strap from sliding off the first shoulder of the wearer.

12. The method of claim 11, wherein said object further comprises a rifle coupled to said shoulder strap.

13. The method of claim 8, wherein said releasable strap securement device is secured to the wearer's clothing adjacent a waist of the wearer.

14. The method of claim 8, wherein said outer end of said release cord is positioned adjacent a free hand of the wearer after said mounting clip engages said object.

* * * * *